US012716621B2

(12) United States Patent
Shanmugam et al.

(10) Patent No.: US 12,716,621 B2
(45) Date of Patent: Aug. 25, 2026

(54) $CO_2$ REFRIGERATION SYSTEM WITH CONVERTIBLE COMPRESSORS

(71) Applicant: Hill Phoenix, Inc., Conyers, GA (US)

(72) Inventors: Senthilkumar Kandappa Goundar Shanmugam, Covington, GA (US); Alireza Behfar, Conyers, GA (US)

(73) Assignee: Hill Phoenix, Inc., Conyers, GA (US)

( * ) Notice: Subject to any disclaimer, the term of this patent is extended or adjusted under 35 U.S.C. 154(b) by 544 days.

(21) Appl. No.: 17/980,934

(22) Filed: Nov. 4, 2022

(65) Prior Publication Data

US 2024/0151437 A1 May 9, 2024

(51) Int. Cl.
*F25B 49/02* (2006.01)
*F25B 9/00* (2006.01)
*F25B 41/20* (2021.01)

(52) U.S. Cl.
CPC ..... *F25B 9/008* (2013.01); *F25B 41/20* (2021.01); *F25B 49/02* (2013.01)

(58) Field of Classification Search
CPC ..... F25B 9/008; F25B 41/20; F25B 49/02
See application file for complete search history.

(56) References Cited

U.S. PATENT DOCUMENTS 2,799,142 A 7/1957 Schubert et al.
4,084,405 A 4/1978 Schibbye et al.
9,726,411 B2 8/2017 Zimmermann
11,029,068 B2 6/2021 Christensen et al.
2010/0132399 A1 6/2010 Mitra et al.
(Continued)

FOREIGN PATENT DOCUMENTS

CA 3068882 11/2020
CN 113654262 11/2021
(Continued)

OTHER PUBLICATIONS

International Search Report and Written Opinion in International Appln. No. PCT/US2023/075541, mailed on Feb. 6, 2024, 15 pages.
(Continued)

*Primary Examiner* — Nael N Babaa
(74) *Attorney, Agent, or Firm* — Fish & Richardson P.C.

(57) ABSTRACT

A refrigeration system includes a receiver, a gas bypass valve, a medium temperature subsystem, a first valve system, a second valve system, and a controller. The gas bypass valve is operable to control a pressure of the refrigerant in the receiver. The medium temperature subsystem includes one or more expansion valves, one or more medium temperature evaporators, and a suction group including two or more transcritical compressors operable to compress gas refrigerant and discharge the compressed gas refrigerant into a discharge line. The first valve system is fluidly coupled to a first one of the transcritical compressors. The second valve system is fluidly coupled to a second one of the transcritical compressors. The controller is configured to activate each of the first and second transcritical compressors to operate as a parallel compressor by modulating its valve system to switch a suction input of the transcritical compressor from an evaporator outlet of the one or more medium temperature evaporators to the outlet of the receiver.

20 Claims, 5 Drawing Sheets

(56) References Cited

U.S. PATENT DOCUMENTS

| | | | | |
|---|---|---|---|---|
| 2013/0298593 | A1 | 11/2013 | Christensen | |
| 2013/0319036 | A1 | 12/2013 | Taras et al. | |
| 2014/0151015 | A1 | 6/2014 | Sun et al. | |
| 2017/0328604 | A1 | 11/2017 | Fredslund et al. | |
| 2017/0343239 | A1* | 11/2017 | Zunino, Jr. | F24F 13/20 |
| 2018/0119997 | A1* | 5/2018 | Siegert | F25B 41/00 |
| 2018/0328628 | A1* | 11/2018 | Sun | F25B 1/10 |
| 2019/0072299 | A1 | 3/2019 | Najafifard et al. | |
| 2019/0368786 | A1* | 12/2019 | Newel | F25B 25/00 |
| 2020/0124330 | A1 | 4/2020 | Hayes | |
| 2024/0110736 | A1 | 4/2024 | Shanmugam et al. | |

FOREIGN PATENT DOCUMENTS

| | | |
|---|---|---|
| EP | 0631095 | 6/1994 |
| GB | 2446062 | 7/2008 |
| JP | 2011247504 | 12/2011 |
| WO | WO 2013016403 | 1/2013 |
| WO | WO 2018079238 | 5/2018 |
| WO | WO 2022249566 | 12/2022 |

OTHER PUBLICATIONS

International Search Report and Written Opinion in International Appln. No. PCT/US2023/078590, mailed on Mar. 6, 2024, 15 pages.

[No Author Listed], Manual 31E08024, "C02 Transcritical eC02 Boost Installation and Operation Manual," Kysor Warren, Jun. 2018, 27 pages.

* cited by examiner

$CO_2$ REFRIGERATION SYSTEM WITH CONVERTIBLE COMPRESSORS

TECHNICAL FIELD

This disclosure relates to cooling systems, particularly cooling systems that use carbon dioxide ($CO_2$) as a refrigerant.

BACKGROUND

Refrigeration systems are often used to provide cooling to temperature-controlled display devices (e.g., cases, merchandisers, etc.) in supermarkets, cold Storage, refrigerated warehouses, process facilities, and other similar facilities. Vapor compression refrigeration systems are a type of refrigeration system which provides such cooling by circulating a fluid refrigerant (e.g., a liquid and/or vapor) through a thermodynamic vapor compression cycle. In a vapor compression cycle, the refrigerant is typically (1) compressed to a high temperature high pressure state (e.g., by a compressor of the refrigeration system), (2) cooled/condensed to a lower temperature state (e.g., in a gas cooler or condenser which absorbs heat from the refrigerant), (3) expanded to a lower pressure (e.g., through an expansion valve), and (4) evaporated to provide cooling by absorbing heat into the refrigerant.

SUMMARY

The present disclosure relates to systems and methods for cooling.

Implementation of the present disclosure include a refrigeration system, including a receiver, a gas bypass valve, a medium temperature subsystem, a first valve system, a second valve system, and a controller. The receiver is configured to collect refrigerant produced by the refrigeration system and including an outlet through which the gas refrigerant exits the receiver. The gas bypass valve is fluidly coupled to the outlet and operable to control a pressure of the refrigerant in the receiver by controlling a flow of the gas refrigerant from the receiver through the gas bypass valve. The medium temperature subsystem includes one or more expansion valves, one or more medium temperature evaporators, and a suction group including two or more transcritical compressors operable to compress gas refrigerant and discharge the compressed gas refrigerant into a discharge line. The first valve system is fluidly coupled to a first one of the transcritical compressors. The second valve system is fluidly coupled to a second one of the transcritical compressors. The controller is configured to determine that one or more first operating parameters are within a first operating range; in response to the determination that the one or more first operating parameters are within the first operating range, activate the first one of the transcritical compressors to operate as a parallel compressor by modulating the first valve system to switch a suction input of the first one of the transcritical compressors from an evaporator outlet of the one or more medium temperature evaporators to the outlet of the receiver; determine that one or more second operating parameters are within a second operating range; and in response to the determination that the one or more second operating parameters are within the second operating range, activate the second one of the transcritical compressors to operate as a parallel compressor by modulating the second valve system to switch a suction input of the second one of the transcritical compressors from an evaporator outlet of the one or more medium temperature evaporators to the outlet of the receiver.

In some implementations, the refrigerant includes carbon dioxide.

In some implementations, the one or more first operating parameters include a flash gas generated in the receiver.

In some implementations, the flash gas generated is determined from ambient conditions, flash tank temperature, and compressor mass flow.

In some implementations, the flash gas generated is determined from a percentage of flash gas bypass valve opening.

In some implementations, the controller is configured to, in response to the determination that the one or more first operating parameters are within the first operating range, close the gas bypass valve.

In some implementations, the refrigeration system further includes a gas cooler/condenser and a heat exchanger system. The heat exchanger system includes a first coil and a second coil. The first coil is configured to carry gas refrigerant passing between the gas cooler/condenser and an inlet of the receiver. The second coil is in heat transfer communication with the first coil. The second coil is configured to carry gas refrigerant passing between the outlet of the receiver and a port of at least one of the first valve system and the second valve system. The heat exchanger system is configured to transfer heat from the second coil to first coil.

In some implementations, the refrigeration system includes an ejector system fluidly coupled between the gas cooler/condenser and the receiver.

In some implementations, the one or more second operating parameters include a flash gas generated.

In some implementations, the one or more second operating parameters include a receiver operating pressure set point.

In some implementations, the refrigeration system includes a variable frequency drive coupled to the first one of the transcritical compressors. The controller is configured to operate the variable frequency drive to modulate a speed of the first one of the transcritical compressors.

In some implementations, the controller is configured to operate the variable frequency drive to modulate a speed of the first one of the transcritical compressors to maintain a receiver operating pressure set point.

In some implementations, the refrigeration system includes a variable frequency drive coupled to the second one of the transcritical compressors. The controller is configured to operate the variable frequency drive to modulate a speed of the second one of the transcritical compressors.

In some implementations, the refrigeration system includes one or more digital unloaders, wherein the controller is configured to operate the one or more digital unloaders to modulate a flow rate through at least one of the two or more transcritical compressors.

In some implementations, at least one of the first valve system and the second valve system includes a three-way valve configured to switch the suction input of the transcritical compressor between gas refrigerant from the one or more medium temperature evaporators and gas refrigerant from the outlet of the receiver.

In some implementations, the controller is configured to, in response to a determination that one or more third operating parameters are within a third operating range, deactivate the first one of the transcritical compressors.

In some implementations, the controller is configured to, in response to a determination that one or more fourth operating parameters are within a fourth operating range, deactivate the second of the transcritical compressors from operating as a parallel compressor.

In some implementations, the controller is configured to determine that one or more third operating parameters are within a third operating range, and, in response to the determination that the one or more third operating parameters are within the third operating range, activate a third one of the transcritical compressors to operate as a parallel compressor by modulating a third valve system to switch a suction input of the third one of the transcritical compressors from an evaporator outlet of the one or more medium temperature evaporators to the outlet of the receiver.

In some implementations, the refrigeration system includes a low temperature subsystem configured to receive liquid refrigerant from the receiver.

In some implementations, the refrigeration system includes include an oil management subsystem including an oil reservoir. The controller is configured to, in response to receiving a signal calling for oil from a compressor that is operating as a parallel compressor, deactivate the compressor from operating as a parallel compressor by modulating the input flow of refrigerant to the compressor from the outlet of the receiver to one or more evaporators, activate another one of the transcritical compressors to operate as a parallel compressor by modulating an input flow of refrigerant from the one or more evaporators to the outlet of the receiver, and provide oil from the reservoir to compressor that has been deactivated as a parallel compressor.

In some implementations, a method of operating a refrigeration system includes: collecting a refrigerant produced by the refrigeration system into a receiver; controlling a pressure of refrigerant in the receiver by controlling a flow of gas refrigerant from the receiver through the gas bypass valve; compressing, by a suction group of transcritical compressors, gas refrigerant received from one or more evaporators; discharging, by the suction group of transcritical compressors, the compressed gas refrigerant into a discharge line and determining that one or more first operating parameters are within a first operating range; in response to the determination that the one or more first operating parameters are within the first operating range, activating a first one of the transcritical compressors to operate as a parallel compressor by modulating a first valve system to switch a suction input of the first one of the transcritical compressors from an evaporator outlet of the one or more evaporators to the outlet of the receiver, determining that one or more second operating parameters are within a second operating range; and, in response to the determination that the one or more second operating parameters are within the second operating range, activating a second one of the transcritical compressors to operate as a parallel compressor by modulating a second valve system to switch a suction input of the second one of the transcritical compressors from an evaporator outlet of the one or more evaporators to the outlet of the receiver.

In some implementations, the method further includes closing the gas bypass valve.

In some implementations, the method further includes adjusting a speed of the first one of the transcritical compressors to maintain a receiver pressure setpoint.

In some implementations, the method further includes, in response to the determination that the second operating parameters are in the second operating range, increasing the compressor speed of the first one of the transcritical compressors to a maximum speed.

In some implementations, the method further includes, in response to the determination that the second operating parameters are in the second operating range, modulating a flow rate through at least one of the two or more transcritical compressors.

In some implementations, the method further includes, in response to a determination that one or more third operating parameters are within a third operating range, deactivating the first one of the transcritical compressors.

In some implementations, the method further includes, in response to receiving a signal calling for oil from a compressor that is operating as a parallel compressor, deactivating the compressor from operating as a parallel compressor by modulating the input flow of refrigerant to the compressor from the outlet of the receiver to one or more evaporators, activating another one of the transcritical compressors to operate as a parallel compressor by modulating an input flow of refrigerant from the one or more evaporators to the outlet of the receiver, and providing oil from a reservoir to the compressor that has been deactivated from operating as a parallel compressor.

Further implementations of the present disclosure include a refrigeration system that includes a receiver, a gas bypass valve, a suction group, a valve system, and a controller. The receiver is configured to collect a gas refrigerant produced by the refrigeration system and includes an outlet through which the gas refrigerant exits the receiver. The gas bypass valve fluidly is coupled to the outlet and operable to control a pressure of the gas refrigerant in the receiver by controlling a flow of the gas refrigerant from the receiver through the gas bypass valve. The suction group includes two or more transcritical compressors operable to compress gas refrigerant and discharge the compressed gas refrigerant into a discharge line. The valve system is fluidly coupled to at least one of the two or more transcritical compressors. The controller is configured to determine an operating parameter of flash gas in the refrigeration system; in response to the determination that the operating parameter of flash gas is within a particular operating range, and activate a first one of the transcritical compressors to operate as a parallel compressor by modulating the valve system to switch a suction input of the transcritical compressor from an evaporator outlet of the one or more evaporators to the outlet of the receiver.

In some implementations, the operating parameter of flash gas is a flash gas generated.

In some implementations, the refrigeration system includes a variable frequency drive configured to modulate a speed of at least one of the transcritical compressors.

In some implementations, the refrigeration system includes a variable frequency drive configured to modulate a speed of at least one of the transcritical compressors.

In some implementations, the controller is configured to: determine that one or more additional operating parameters are within a second particular operating range, and, in response to the determination that the one or more additional operating parameters are within the second operating range, activate a second one of the transcritical compressors to operate as a parallel compressor by modulating a valve system such that the transcritical compressor receives gas refrigerant from the outlet of the receiver.

In some implementations, the refrigerant includes carbon dioxide.

Further implementations of the present disclosure include a method of operating a refrigeration system that includes: collecting a gas refrigerant produced by the refrigeration system into a receiver; controlling a pressure of the gas refrigerant in the receiver by controlling a flow of gas refrigerant from the receiver through the gas bypass valve;

operating two or more transcritical compressors to compress gas refrigerant and discharge the compressed gas refrigerant into a discharge line; determining that an operating parameter of flash gas in the refrigeration system is within a particular operating range; and, in response to the determination that the operating parameter of flash gas is within the particular operating range, activating a first one of the transcritical compressors to operate as a parallel compressor by modulating a valve system to switch a suction input of the transcritical compressor from an evaporator outlet of the one or more transcritical evaporators to the outlet of the receiver.

In some implementations, determining that the operating parameter of flash gas in the refrigeration system is within the particular operating range includes determining that a flash gas generated is within the particular operating range.

In some implementations, the flash gas generated is determined from ambient conditions and compressor mass flow.

In some implementations, flash gas generated is determined from a percentage of flash gas bypass valve opening and a flash gas bypass valve flow rate.

In some implementations the method further includes, in response the determination that the operating parameter of flash gas is within the particular operating range, closing the gas bypass valve.

In some implementations, the method further includes determining that one or more additional operating parameters are within a second particular operating range, and, in response to the determination that the one or more additional operating parameters are within the second operating range, activating a second one of the transcritical compressors to operate as a parallel compressor by modulating a valve system such that the transcritical compressor receives gas refrigerant from the outlet of the receiver.

In some implementations, the one or more additional operating parameters include a receiver operating pressure set point.

In some implementations, the method further includes determining that one or more additional operating parameters are within a second particular operating range, and, in response to the determination that the one or more additional operating parameters are within the second particular operating range, increasing a speed of the first one of the transcritical compressors.

In some implementations, the method further includes determining that one or more additional operating parameters are within a second particular operating range, and, in response to the determination that the one or more additional operating parameters are within the second particular operating range, deactivating the first one of the transcritical compressors to operate as a parallel compressor by modulating a valve system such that the transcritical compressor does not receive gas refrigerant from the outlet of the receiver.

Further implementations of the present disclosure include an oil management system that includes one or more oil reservoirs, one or more oil separators coupled to the oil reservoirs, and a controller. The controller is configured to: receive a signal calling for oil from a compressor that is operating as a parallel compressor, and, in response to receiving the signal: deactivate the compressor from operating as a parallel compressor by modulating the input flow of refrigerant to the compressor from the outlet of a receiver to one or more evaporators; activate another compressor to operate as a parallel compressor by modulating an input flow of refrigerant from the one or more evaporators to the outlet of the receiver; and provide oil from at least one the one or more reservoirs to the compressor that has been deactivated from operating as a parallel compressor.

Particular implementations of the subject matter described in this specification can be implemented so as to realize one or more of the following advantages.

Implementations of the present disclosure may allow a system to operate more efficiently with varying environmental conditions.

Implementations of the present disclosure may help to balance the charge of a system for winter and summer operating conditions.

Implementations of the present disclosure may reduce the number of components required to achieve parallel compression during environmental conditions that benefit from the use of parallel compression.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

In various implementations, a cooling system includes one or more compressors that are convertible from operation as compressors within a suction group of a medium temperature subsystem to operation as a parallel compressors (e.g., interstage compressors), and vice versa. Conversion can be achieved using a modulating three-way valve that switches an input from each convertible compressor to receive refrigerant from the output of a receiver/flash tank instead of refrigerant from the output of the evaporators of the medium temperature system. The system can, in some implementations, be expanded from one to many compressors depending on the system size, location of the system based on the percentage of flash gas generation during the year-around period.

Examples of refrigeration systems with temperature suction group compressors convertible to parallel compressors (e.g., interstage compressors) are described below. Referring generally to the Figures, a $CO_2$ refrigeration system is shown, according to various exemplary implementations. The $CO_2$ refrigeration system may be a vapor compression refrigeration system which uses primarily carbon dioxide (i.e., $CO_2$) as a refrigerant. In some implementations, a $CO_2$ booster system is used to provide cooling for temperature controlled display devices in a supermarket or other similar facility.

Figure 1:
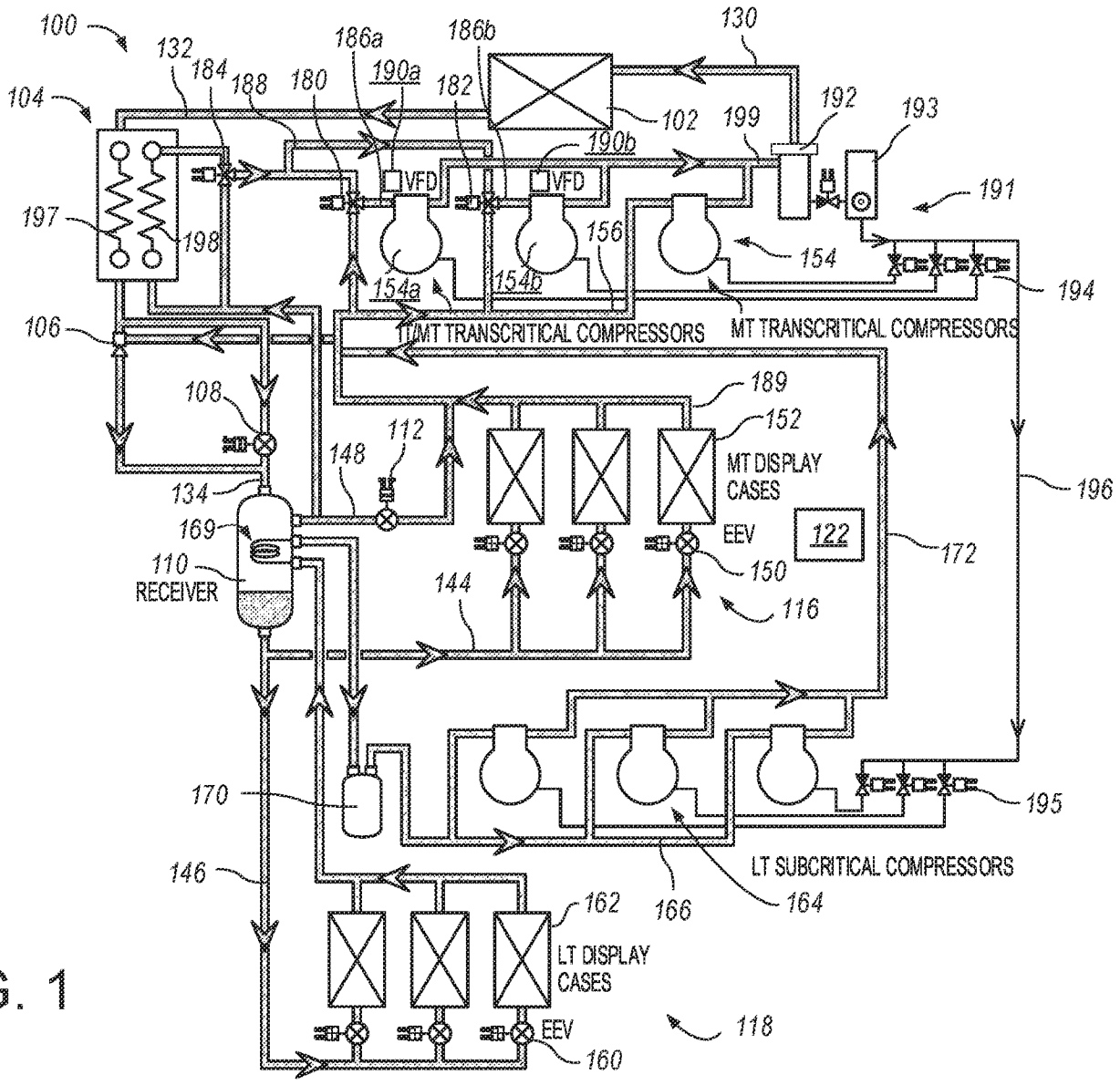
FIG. 1 is a block diagram of a $CO_2$ transcritical booster system system having transcritical compressors that are convertible to parallel compressors according to an exemplary implementation.

FIG. 1 is a block diagram of a $CO_2$ refrigeration system according to an exemplary implementation. $CO_2$ refrigeration system 100 may be a vapor compression refrigeration system which uses primarily carbon dioxide ($CO_2$) as a refrigerant. However, it is contemplated that other refrigerants can be substituted for $CO_2$ without departing from the teachings of the present disclosure.

$CO_2$ refrigeration system 100 and is shown to include a system of pipes, conduits, or other fluid channels for transporting the $CO_2$ refrigerant between various components of $CO_2$ refrigeration system 100. The thermodynamic components of $CO_2$ refrigeration system 100 include a gas cooler/condenser 102, a heat exchanger system 104, an ejector 106, high pressure valve 108, a receiver 110, a gas bypass valve 112, a medium-temperature ("MT") subsystem 116, a low-temperature ("LT") subsystem 118, and a controller 122.

Gas cooler/condenser 102 may be a heat exchanger or other similar device for removing heat from the $CO_2$ refrigerant. Gas cooler/condenser 102 is shown receiving $CO_2$ gas from fluid conduit 130. In some implementations, the $CO_2$ gas in fluid conduit 130 may have a pressure within a range from approximately 45 bar to approximately 100 bar (i.e., about 650 psig to about 1450 psig), depending on ambient temperature and other operating conditions. In some implementations, gas cooler/condenser 102 may partially or fully condense $CO_2$ gas into liquid $CO_2$ (e.g., if system operation is in a subcritical region). The condensation process may result in fully saturated $CO_2$ liquid or a two-phase liquid-vapor mixture (e.g., having a thermodynamic vapor quality between 0 and 1). In other implementations, gas cooler/condenser 102 may cool the $CO_2$ gas (e.g., by removing superheat) without condensing the $CO_2$ gas into $CO_2$ liquid (e.g., if system operation is in a supercritical region). In some implementations, the cooling/condensation process is an isobaric process. Gas cooler/condenser 102 is shown outputting the cooled and/or condensed $CO_2$ refrigerant into fluid conduit 132.

In some implementations, $CO_2$ refrigeration system 100 includes a temperature sensor and a pressure sensor configured to measure the temperature and pressure of the $CO_2$ refrigerant exiting gas cooler/condenser 102. Sensors can be installed along fluid conduit 132, within gas cooler/condenser 102, or otherwise positioned to measure the temperature and pressure of the $CO_2$ refrigerant exiting gas cooler/condenser 102. In some implementations, $CO_2$ refrigeration system 100 includes a condenser fan that provides airflow across gas cooler/condenser 102. The speed of the condenser fan can be controlled to increase or decrease the airflow across gas cooler/condenser 102 to modulate the amount of cooling applied to the $CO_2$ refrigerant within gas cooler/condenser 102. In some implementations, $CO_2$ refrigeration system 100 also includes a temperature sensor and/or a pressure sensor configured to measure the temperature and/or pressure of the ambient air that flows across gas cooler/condenser 102 to provide cooling for the $CO_2$ refrigerant contained therein.

High pressure valve 108 receives the cooled and/or condensed $CO_2$ refrigerant from fluid conduit 132 and outputs the $CO_2$ refrigerant to fluid conduit 134. High pressure valve 108 may control the pressure of the $CO_2$ refrigerant in gas cooler/condenser 102 by controlling an amount of $CO_2$ refrigerant permitted to pass through high pressure valve 108. In some implementations, high pressure valve 108 is a high pressure thermal expansion valve (e.g., if the pressure in fluid conduit 132 is greater than the pressure in fluid conduit 134). In such implementations, high pressure valve 108 may allow the $CO_2$ refrigerant to expand to a lower pressure state. The expansion process may be an isenthalpic and/or adiabatic expansion process, resulting in a two-phase flash of the high pressure $CO_2$ refrigerant to a lower pressure, lower temperature state. The expansion process may produce a liquid/vapor mixture (e.g., having a thermodynamic vapor quality between 0 and 1). In some implementations, the $CO_2$ refrigerant expands to a pressure of approximately 38 bar (e.g., about 550 psig), which corresponds to a temperature of approximately 40° F. The $CO_2$ refrigerant then flows from fluid conduit 134 into receiver 110. In some implementations, high pressure valve 108 can be eliminated and an ejector (e.g., ejector 106) can function as both high pressure valve and ejector.

Receiver 110 collects the $CO_2$ refrigerant from fluid conduit 134. In some implementations, receiver 110 may be a flash tank or other fluid reservoir. Receiver 110 includes a $CO_2$ liquid portion and a $CO_2$ vapor portion and may contain a partially saturated mixture of $CO_2$ liquid and $CO_2$ vapor. In some implementations, receiver 110 separates the $CO_2$ liquid from the $CO_2$ vapor. In one implementation, the receiver operating pressure of receiver 110 is about 60 to 90 bar. In another implementation, the receiver operating pressure of receiver 110 is about 45 to 60 bar, or 45 bar to 90 bar.

$CO_2$ liquid may exit receiver 110 and pass into conduit 144 and conduit 146. Conduit 144 may be a liquid header leading to MT subsystem 116. Conduit 146 may be a liquid header leading to LT subsystem 118. The $CO_2$ vapor may exit receiver 110 through conduit 148. Conduit 148 is shown leading the $CO_2$ vapor to a gas bypass valve 112 (described in greater detail below).

In some implementations, $CO_2$ refrigeration system 100 includes temperature sensors and/or pressure sensors configured to measure the temperature and pressure within receiver 110. Sensors can be installed in or on receiver 110, or along any of the fluid conduits that contain $CO_2$ refrigerant at the same temperature and/or pressure as receiver 110, as the case may be.

MT subsystem 116 is shown to include one or more expansion valves 150, one or more MT evaporators 152, and one or more transcritical compressors 154. In various implementations, any number of expansion valves 150, MT evaporators 152, and transcritical compressors 154 may be present. Expansion valves 150 may be electronic expansion valves or other similar expansion valves. Expansion valves 150 are shown receiving liquid $CO_2$ refrigerant from fluid conduit 144 and outputting the $CO_2$ refrigerant to MT evaporators 152. Expansion valves 150 may cause the $CO_2$ refrigerant to undergo a rapid drop in pressure, thereby expanding the $CO_2$ refrigerant to a lower pressure, lower temperature two-phase state. In some implementations, expansion valves 150 may expand the $CO_2$ refrigerant to a pressure of approximately 20 bar to 25 bar. The expansion process may be an isenthalpic and/or adiabatic expansion process.

MT evaporators 152 are shown receiving the cooled and expanded $CO_2$ refrigerant from expansion valves 150. In some implementations, MT evaporators 152 may be associated with display cases/devices (e.g., if $CO_2$ refrigeration system 100 is implemented in a supermarket setting). MT evaporators 152 may be configured to facilitate the transfer of heat from the display cases/devices into the $CO_2$ refrigerant. The added heat may cause the $CO_2$ refrigerant to evaporate partially or completely. According to example implementations, the $CO_2$ refrigerant is fully evaporated in MT evaporators 152. In some implementations, the evaporation process may be an isobaric process. MT evaporators 152 are shown outputting the $CO_2$ refrigerant via suction line 156, leading to transcritical compressors 154. Transcritical compressors 154 combine to form a compressor suction group for MT subsystem 116.

Transcritical compressors 154 compress the $CO_2$ refrigerant into a superheated gas having a pressure within a range of approximately 45 bar to approximately 100 bar. The output pressure from transcritical compressors 154 may vary depending on ambient temperature and other operating conditions. In the example shown in FIG. 1, transcritical compressors 154 operate in a transcritical mode. In operation, the $CO_2$ discharge gas exits suction group transcritical compressors 154 and flows through conduit 130 into gas cooler/condenser 102.

LT subsystem 118 is shown to include one or more expansion valves 160, one or more LT evaporators 162, and one or more subcritical compressors 164. In various implementations, any number of expansion valves 160, LT evaporators 162, and subcritical compressors 164 may be present. In some implementations, LT subsystem 118 may be omitted and the $CO_2$ refrigeration system 100 may operate with an AC module interfacing with only MT subsystem 116.

Expansion valves 160 may be electronic expansion valves or other similar expansion valves. Expansion valves 160 are shown receiving liquid $CO_2$ refrigerant from fluid conduit 146 and outputting the $CO_2$ refrigerant to LT evaporators 162. Expansion valves 160 may cause the $CO_2$ refrigerant to undergo a rapid drop in pressure, thereby expanding the $CO_2$ refrigerant to a lower pressure, lower temperature two-phase state. The expansion process may be an isenthalpic and/or adiabatic expansion process. In certain implementations, expansion valves 160 may expand the $CO_2$ refrigerant to a lower pressure than expansion valves 160, thereby resulting in a lower temperature $CO_2$ refrigerant. Accordingly, LT subsystem 118 may be used in conjunction with a freezer system or other lower temperature display cases.

LT evaporators 162 are shown receiving the cooled and expanded $CO_2$ refrigerant from expansion valves 160. In some implementations, LT evaporators may be associated with display cases/devices (e.g., if $CO_2$ refrigeration system 100 is implemented in a supermarket setting). LT evaporators 162 may be configured to facilitate the transfer of heat from the display cases/devices into the $CO_2$ refrigerant. The added heat may cause the $CO_2$ refrigerant to evaporate partially or completely. In some implementations, the evaporation process may be an isobaric process.

LT evaporators 162 are shown outputting the $CO_2$ refrigerant via suction line 166, leading to subcritical compressors 164. In this example, before reaching subcritical compressors 164, the refrigerant passes through heat exchanger 169 in receiver 110 and to accumulator 170. LT subsystem 118 can also be built without heat exchanger 169 and accumulator 170.

Subcritical compressors 164 compress the $CO_2$ refrigerant. In some implementations, subcritical compressors 164 may compress the $CO_2$ refrigerant to a pressure of approximately 30 bar, having a saturation temperature of approximately 23° F. In this example, subcritical compressors 164 operate in a subcritical mode. Subcritical compressors 164 are shown outputting the $CO_2$ refrigerant through discharge line 172. Discharge line 172 may be fluidly connected with the suction (e.g., upstream) side of transcritical compressors 154.

$CO_2$ refrigeration system 100 is shown to include a gas bypass valve 112. Gas bypass valve 112 may receive the $CO_2$ vapor from fluid conduit 148 and output the $CO_2$ refrigerant to MT subsystem 118. In some implementations, gas bypass valve 112 is arranged in series with transcritical compressors 154. In other words, $CO_2$ vapor from receiver 110 may pass through both gas bypass valve 112 and transcritical compressors 154. Transcritical compressors 154 may compress the $CO_2$ vapor passing through gas bypass valve 112 from a low pressure state (e.g., approximately 30 bar or lower) to a high pressure state (e.g., approximately 45-100 bar).

Gas bypass valve 112 can be operated to control a flow of gas refrigerant from receiver 110 into suction line 156. Gas bypass valve 112 may be operated to regulate or control the pressure within receiver 110 (e.g., by adjusting an amount of $CO_2$ refrigerant permitted to pass through gas bypass valve 112). For example, gas bypass valve 112 may be adjusted (e.g., variably opened or closed) to adjust the mass flow rate, volume flow rate, or other flow rates of the $CO_2$ refrigerant through gas bypass valve 112. Gas bypass valve 112 may be opened and closed (e.g., manually, automatically, by a controller, etc.) as needed to regulate the pressure within receiver 110.

In some implementations, gas bypass valve 112 includes a sensor for measuring a flow rate (e.g., mass flow, volume flow, etc.) of the $CO_2$ refrigerant through gas bypass valve 112. In other implementations, gas bypass valve 112 includes an indicator (e.g., a gauge, a dial, etc.) from which the position of gas bypass valve 112 may be determined. This position may be used to determine the flow rate of $CO_2$ refrigerant through gas bypass valve 112, as such quantities (e.g., mass flow or volumetric flow or flow rate) may be proportional or otherwise related.

In some implementations, gas bypass valve 112 is a thermal expansion valve. According to one implementation, the pressure within receiver 110 is regulated by gas bypass valve 112 to a pressure of approximately 38 bar.

$CO_2$ refrigeration system 100 includes parallel compressor activation valve 180, parallel compressor activation valve 182, and heat exchanger bypass valve 184. In this example, each of parallel compressor activation valve 180, parallel compressor activation valve 182, and heat exchanger bypass valve 184 is a 3-way valve.

Parallel compressor activation valve 180 is installed such that fluid communication to a suction input line **186*a* to transcritical compressor 154*a* can be modulated to switch between a flow refrigerant from conduit 188 and a flow of refrigerant conduit 189. Conduit 188 fluidly couples parallel compressor activation valve 180 with an outlet of receiver 110. Conduit 189 fluidly couples parallel compressor activation valve 180 with evaporator outlets of MT evaporators 152**.

Parallel compressor activation valve 182 is installed such that fluid communication to a suction input line **186*b* to transcritical compressor 154*b* can be modulated to switch between a flow refrigerant from conduit 188 and a flow of refrigerant conduit 189. Conduit 188 fluidly couples parallel compressor activation valve 182 with an outlet of receiver 110. Conduit 189 fluidly couples parallel compressor activation valve 182 with evaporator outlets of MT evaporators 152**.

Compressor mass flow rate/capacity can be controlled by compressor speed (e.g., 25 Hz to 75 Hz) or by using unloaders. In the example shown in FIG. 1, $CO_2$ refrigeration system 100 includes variable frequency drive **190*a* and variable frequency drive 190*b*. Variable frequency drive 190*a* and variable frequency drive 190*b* are operably coupled to controller 122. Variable frequency drive 190*a* can be operated to control a speed of transcritical compressor 154***a*. Variable frequency drive 190*b* can be operated to control a speed of transcritical compressor 154*b*.

In other implementations, compressor mass flow rate/capacity is controlled using a digital unloader. The digital unloader can include a solenoid valve that is energized to unload the compressor and de-energized to load the compressor.

$CO_2$ refrigeration system 100 includes oil management system 191. Oil management system 191 includes oil separator 192 and oil reservoir 193. Valves 194 and valves 195 can be operated to control the provision of oil to transcritical compressors 154 and subcritical compressors 164, respectively, by way of oil manifold 196.

In various implementations, one or more of transcritical compressors 154 are activated to operate as a parallel compressor. In one implementation, transcritical compressor 154*a* is activated to operate as a parallel compressor in response to flash gas generated being within particular predetermined operating range. The flash gas generated can be based on, for example, an amount of flash gas generated (e.g., mass flow rate) or a percentage or fraction of flash gas generated. For example, transcritical compressor 154*a* can be activated if the percentage of flash gas generated is greater than a predetermined level. The predetermined level can be as low as 5% up to 100%. If multiple small compressors are used as parallel and MT compressors, then small compressors at low speed can process very low amount of flash gas. In this case, transcritical compressor 154*a* can process a lower % (or amount) of flash gas to a higher % (or amount) based on compressor size and number of parallel convertible compressors. Based on the system size, compressor size, amount of flash gas generated, the controller can be used determine when to activate the parallel compressor.

In the example shown in FIG. 1, transcritical compressor 154*a* is activated as a parallel compressor by modulating parallel compressor activation valve 180 such that the suction input line of transcritical compressor 154*a* receives refrigerant from the outlet of receiver 110 instead of the output of MT evaporators 152.

In some implementations, a second transcritical compressor (e.g., transcritical compressor 154*b*) is activated to operate as a parallel compressor in response to an operating parameter (e.g., receiver operating pressure, a mass flow rate of flash gas generated, or a percentage of flash gas generated being within second particular predetermined operating range). As one example, transcritical compressor 154*b* can be activated if the percentage of flash gas generated is greater than a predetermined level. The predetermined level can be as low as 5% up to 100%. If multiple small compressors are used as parallel and MT compressors, then small compressors at low speed can process very low amount of flash gas. In this case, transcritical compressor 154*b* can process a lower % (or amount) of flash gas to a higher % (or amount) based on compressor size and number of parallel convertible compressors. Based on the system size, compressor size, amount of flash gas generated, the controller can be used determine when to activate the parallel compressor.

In the example shown in FIG. 1, transcritical compressor 154*b* is activated as a parallel compressor by modulating parallel compressor activation valve 182 such that the suction input line of transcritical compressor 154*b* receives refrigerant from the outlet of receiver 110 instead of the output of MT evaporators 152.

In this manner, suction group compressors (such as transcritical compressors 154*a* and 154*b*) can be successively converted to operate as parallel compressors. Each successive conversion to parallel operation can be performed in response to particular operating conditions.

Heat exchanger system includes coil 197 and coil 198. Coil 197 is in heat transfer communication with coil 198, such that heat in refrigerant passing through coil 198 is transferred to refrigerant passing through coil 197.

High pressure valve 108 and ejector 106 are installed in parallel. Refrigerant from gas cooler/condenser 102 passes through coil 197 of heat exchanger system 104 and then to high pressure valve 108, the ejector 106, or both. Heat exchanger bypass valve 184 can be operated such that refrigerant from receiver 110 passes through coil 198 and then to the suction side of compressors 154.

Heat exchanger bypass valve 184 can be modulated so that gas refrigerant from receiver 110 bypasses coil 198 of heat exchanger system 104 and passes, for example, directly from receiver 110 to a suction inlet of transcritical compressors 154. Ejector 106 is provided between heat exchanger system 104 and receiver 110. Ejector 106 is in parallel with high pressure valve 108.

In this example, ejector 106 is a high-pressure ejector. Ejector 106 draws the suction gas from the MT evaporator header conduit (or line) and increases the pressure of that gas to the receiver's pressure. Ejector 106 has an internal nozzle to use the kinetic energy of the motive gas (coming from gas cooler 102) to draw and lift the MT suction gas up to the receiver pressure. A high-pressure ejector can also be referred to as a lift ejector because it lifts the MT gas from the lower pressure of the MT suction line to the higher pressure of the receiver. Excess motive gas from the gas cooler 102, which could not pass through the ejector, could pass via the high-pressure valve 108. Other types of ejectors can be used.

In some implementations, the controller uses a compressor that is operating as a parallel compressor to control the pressure of the gas refrigerant in the receiver. In one implementation, one of the compressors of a suction group of a medium temperature system is activated to operate as a parallel compressor in response to the pressure of the gas refrigerant in a receiver exceeding a pressure setpoint, and deactivated from operating as a parallel compressor in response to the pressure of the gas refrigerant in the receiver dropping below the pressure setpoint.

When operating as a parallel compressor, each of transcritical compressors 154 can be used to draw non-condensed $CO_2$ vapor from receiver 110. Operating one or more of transcritical compressors 154 can be used as a way of achieving pressure control and regulation. The parallel compressor compresses the $CO_2$ vapor and discharges the compressed gas into discharge line 199. Discharge line 199 may be fluidly connected with fluid conduit 130. Accordingly, compressors 154*a*, 154*b* may operate in parallel with the remaining MT compressors by discharging the compressed $CO_2$ gas into a shared fluid conduit (e.g., fluid conduit 130).

Parallel compressors may receive the $CO_2$ vapor at a relatively higher pressure than the $CO_2$ vapor received by the remaining MT compressors 154. This differential in pressure may correspond to the pressure differential across gas bypass valve 112. In some embodiments, the parallel compressors (e.g., 154*a*, 154*b*) may require less energy to compress an equivalent amount of $CO_2$ vapor to the high pressure state (e.g., in fluid conduit 130) as a result of the higher pressure of $CO_2$ vapor entering the parallel compressor.

In certain implementations, gas bypass valve 112 is omitted and the pressure within receiver 110 is regulated using a parallel compressor setup. In other implementations, the pressure within receiver 110 is regulated using gas bypass valve 112. In other implementations, both gas bypass valve 112 and one or more compressors 154 (operating as parallel compressors) are used to regulate the pressure within receiver 110.

Applications of systems and processes described in the present disclosure include a commercial supermarket, a cold storage warehouse, and a process cooling facility. In one implementation, a commercial supermarket has two sets of evaporators, for example, 60 bar and 45 bar medium temp evaporators. In some implementations, a cold storage warehouse or process cooling facility includes refrigeration and air conditioning.

Figure 2:
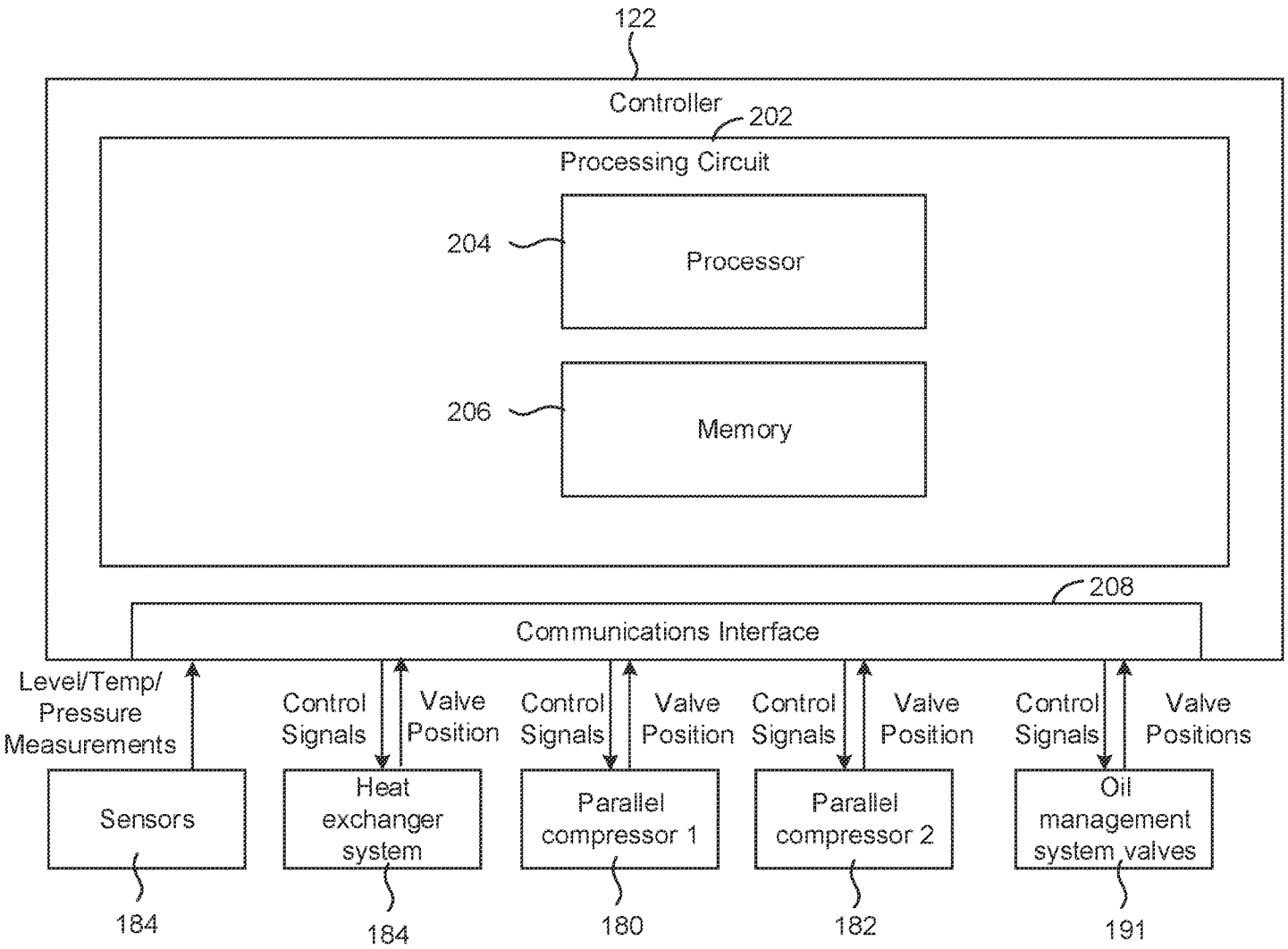
FIG. 2 is a block diagram illustrating a controller according to an exemplary implementation.

FIG. 2 is a block diagram illustrating controller 122 in greater detail according to an exemplary implementation. Controller 122 may receive signals from one or more measurement devices (e.g., pressure sensors, temperature sensors, flow sensors, etc.) located within $CO_2$ refrigeration system 100. Controller 122 may use the input signals to determine appropriate control actions for controllable devices of $CO_2$ refrigeration system 100 (e.g., compressors, valves, flow diverters, power supplies, etc.). For example, controller 122 is shown providing control signals to gas bypass valve 112, parallel compression activation valve 180, parallel compressor activation valve 182, and heat exchanger bypass valve 184.

In some implementations, controller 122 is configured to operate gas bypass valve 112, parallel compressor activation valve 180, parallel compressor activation valve 182, and heat exchanger bypass valve 184. Controller 122 can operate parallel compressor activation valve 180 to activate and deactivate transcritical compressor 154*a* to operate as a parallel compressor. Controller 122 can operate parallel compressor activation valve 182 to activate and deactivate transcritical compressor 154*b* to operate as a parallel compressor. In some implementations, controller 122 operates one or more of gas bypass valve 112, parallel compressor activation valve 180, parallel compressor activation valve 182, and heat exchanger bypass valve 184 to maintain one or more operating parameters of the system at a desired setpoint or within a desired range. In certain implementations, controller 122 uses a valve position of gas bypass valve 112 as a proxy for $CO_2$ refrigerant flow rate. In some implementations, controller 122 operates high pressure valve 108 and expansion valves of MT subsystem 116, and LT subsystem 118 to regulate the flow of refrigerant in system 100 and various sub-systems of system 100. Controller 122 is also coupled to valves for controlling oil management system 191.

Controller 122 may include feedback control functionality for adaptively operating the various components of $CO_2$ refrigeration system 100. For example, controller 122 may receive a setpoint (e.g., a level setpoint, a temperature setpoint, a pressure setpoint, a flow rate setpoint, a power usage setpoint, etc.) and operate one or more components of system 100 to achieve the setpoint. The setpoint may be specified by a user (e.g., via a user input device, a graphical user interface, a local interface, a remote interface, etc.) or automatically determined by controller 122 based on a history of data measurements. In some implementations, controller 122 receives a setpoint for a liquid level of one or more of the receivers in $CO_2$ refrigeration system 100.

Controller 122 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some implementations, controller 122 is a local controller for $CO_2$ refrigeration system 100. In other implementations, controller 122 is a supervisory controller for a plurality of controlled subsystems (e.g., a refrigeration system, an AC system, a lighting system, a security system, etc.). For example, controller 122 may be a controller for a comprehensive building management system incorporating $CO_2$ refrigeration system 100. Controller 122 may be implemented locally, remotely, or as part of a cloud-hosted suite of building management applications.

Controller 122 includes a communications a processing circuit 202. Processing circuit 202 is shown to include a processor 204 and memory 206. Processor 204 can be implemented as a general purpose processor, an application specific integrated circuit (ASIC), one or more field programmable gate arrays (FPGAs), a group of processing components, a microcontroller, or other suitable electronic processing components. Memory 206 (e.g., memory device, memory unit, storage device, etc.) may be one or more devices (e.g., RAM, ROM, solid state memory, hard disk storage, etc.) for storing data and/or computer code for completing or facilitating the various processes, layers and modules described in the present application. Memory 206 may be or include volatile memory or non-volatile memory. Memory 206 may include database components, object code components, script components, or any other type of information structure for supporting the various activities and information structures described in the present application. According to an exemplary implementation, memory 206 is communicably connected to processor 204 via processing circuit 202 and includes computer code for executing (e.g., by processing circuit 202 and/or processor 204) one or more processes or control features described herein.

Controller 122 includes a communications interface 208. Communications interface 208 can be or include wired or wireless interfaces (e.g., jacks, antennas, transmitters, receivers, transceivers, wire terminals, etc.) for conducting electronic data communications. Data communications may be conducted via a direct connection (e.g., a wired connection, an ad-hoc wireless connection, etc.) or a network connection (e.g., an Internet connection, a LAN, WAN, or WLAN connection, etc.). For example, communications interface 208 can include an Ethernet card and port for sending and receiving data via an Ethernet-based communications link or network. In another example, communications interface 208 can include a Wi-Fi transceiver or a cellular or mobile phone transceiver for communicating via a wireless communications network.

Figure 3:
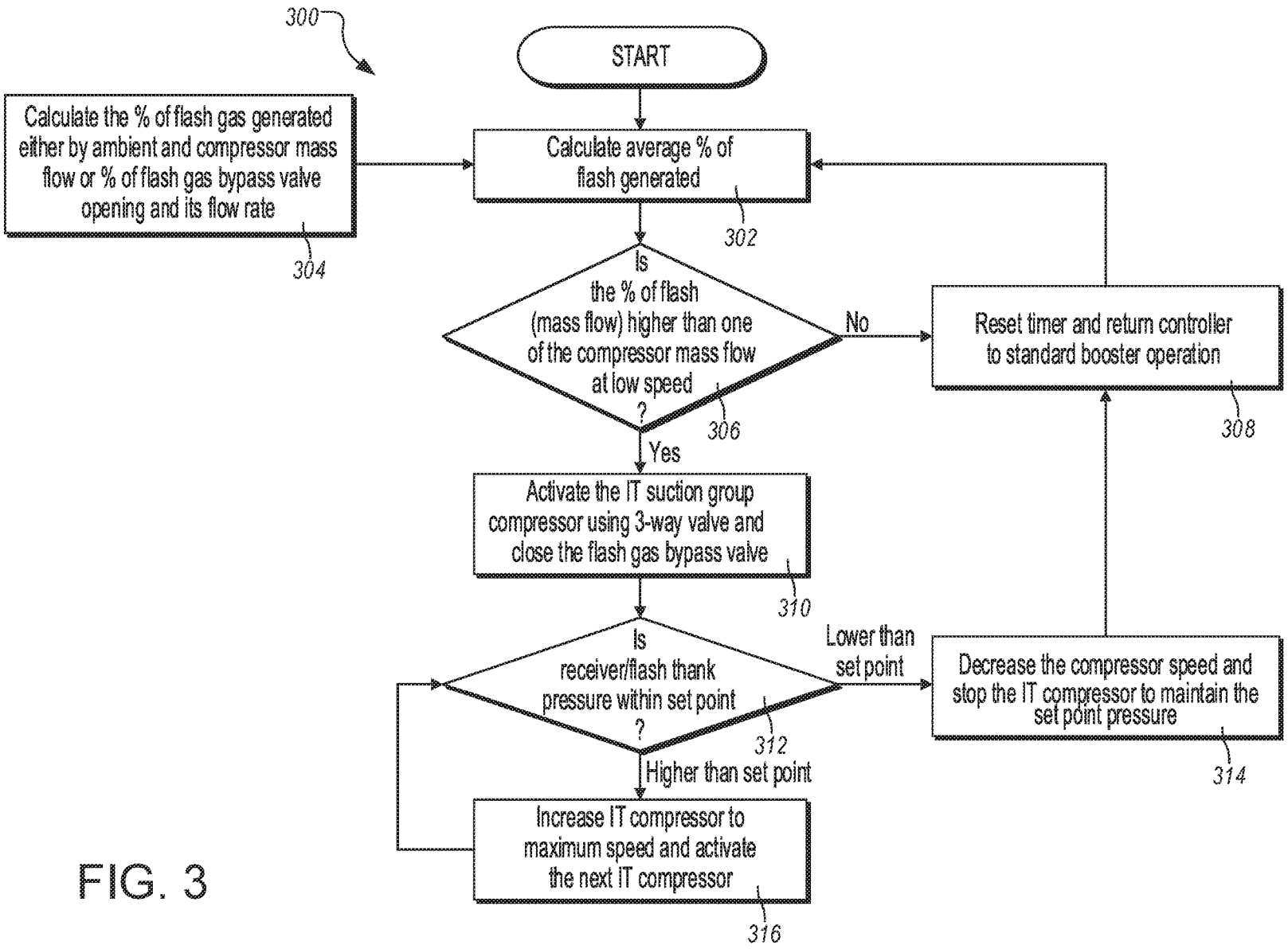
FIG. 3 is a flow diagram of an example process that can be implemented on a refrigeration system with convertible compressors according to some implementations.

FIG. 3 is a flow diagram of an example process 300 that can be implemented to activate compressors of a refrigeration system to operate as parallel compressors based on flash gas characteristics in the refrigeration system according to some implementations.

At the start of process 300, the flash gas generated in the receiver is calculated (302). In some cases, an amount of flash gas generated is determined by ambient conditions, flash tank temperature, and compressor mass flow. In other cases, an amount of flash gas generated is determined by percentage of flash gas bypass valve opening (and a corresponding estimate of gas flow rate through the bypass valve) (304).

The percentage of the flash gas inside the receiver (e.g., 43%) can be determined by the gas cooler outlet conditions (i.e., temperature and pressure) and flash tank temperature. For example, 43% flash gas inside the receiver means that 43% of the mass of refrigerant is vapor and 57% is liquid. The gas cooler outlet temperature depends on the ambient conditions (as it cannot be cooled lower than the ambient temperature). The gas cooler pressure can be maintained by the high-pressure valve at an optimum value based on the ambient conditions. Therefore, the percentage of the flash gas inside the receiver will vary depending on the ambient conditions and flash tank temperature.

The compressor mass flow rate is needed to calculate the amount of the flash gas that flows in and out of the receiver. For example, if the compressor mass flow rate is 5000 lb/hr, and the percentage of the flash gas generated is 43%, that means 5000*43/100=2150 lb/hr vapor (flash gas) and 5000*57/100=2850 lb/hr liquid flows in and out of the flash tank.

Based on a calculated flash gas generated, a determination is made whether the amount (based on the percentage) of flash gas generated is higher than one of the compressor's mass flow at a particular speed (which may be a low speed) (306). If the amount of flash gas is not higher than one or the compressor's mass flow rate at the particular speed, the timer is reset and the controller is set to standard booster operation (308).

If the determination is that the flash gas generated is higher than one of the compressor's mass flow at the particular speed (if variable frequency drive is used) or at particular compressor mass flow rate (if the compressor uses digital unloaders), one of the compressors is activated to operate as a parallel compressor (310). In some implementations, activation is carried out by closing a gas bypass valve (e.g., gas bypass valve 112) and modulating a 3-way valve (e.g., parallel compressor activation valve 180) to switch a suction input of the compressor from refrigerant from the output of medium temperature evaporators to refrigerant from a receiver.

During operation of one of the compressors as a parallel compressor, a determination may be made (e.g., periodically, such as every minute or every second) whether receiver operating pressure (e.g., the pressure in the flash tank) is within a selected set point (312). If receiver operating pressure is lower than the setpoint, the compressor speed can be decreased (or unloaded/energized) and the parallel compressor stopped in order to maintain the set point pressure (314). If the receiver pressure is higher than the setpoint, the parallel compressor can be increased to maximum speed (or loaded/de-energized) and the next parallel compressor activated (316).

Operation of the second compressor and any successively activated additional compressors can be carried out in a similar manner to that described above for the first compressor.

Figure 4:
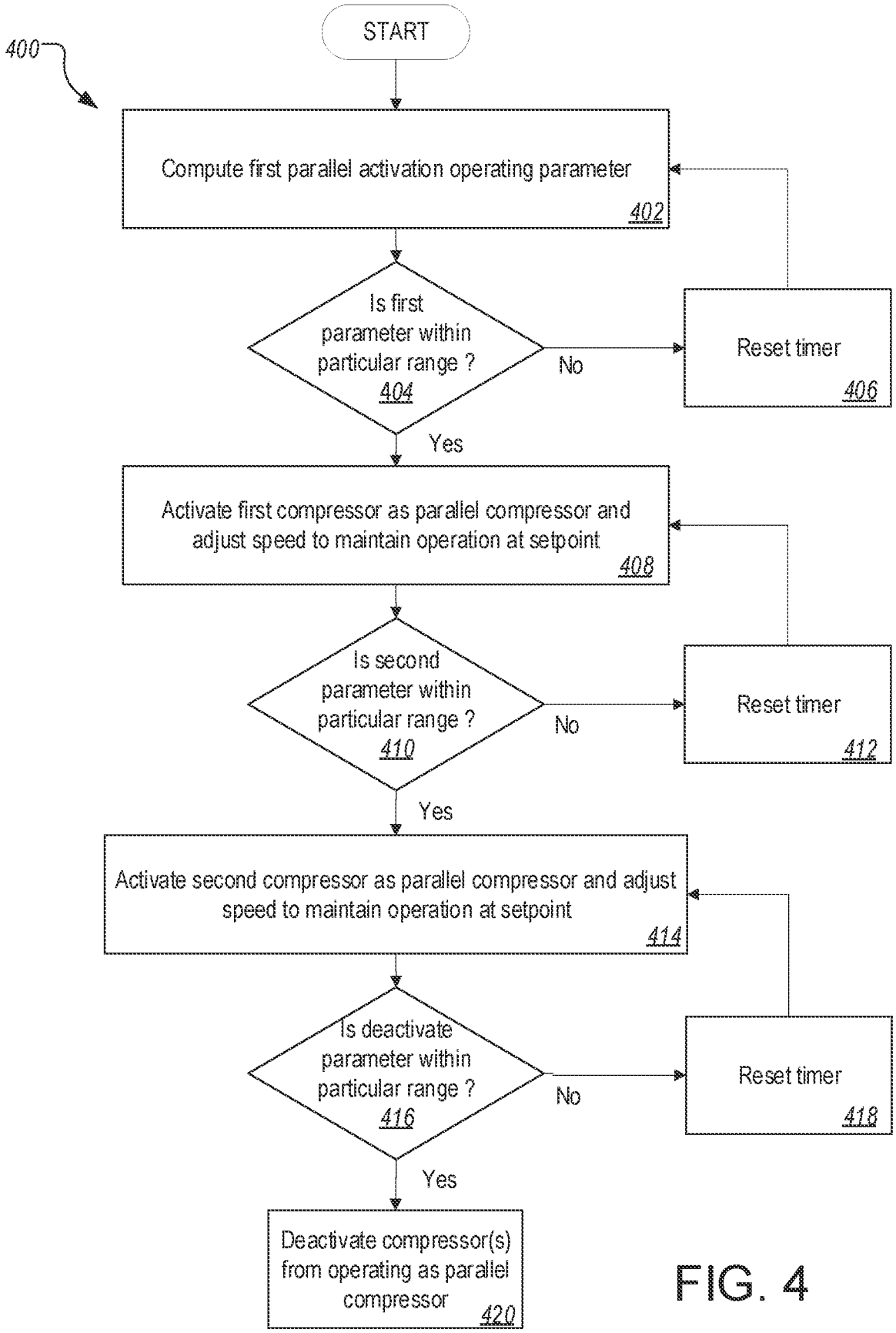
FIG. 4 is a flow diagram of an example process that can be implemented on a refrigeration system to activate and deactivate convertible compressors according to some implementations.

FIG. 4 is a flow diagram of an example process 400 that can be implemented to activate and deactivate compressors of a refrigeration system to operate as parallel compressors according to some implementations. A first parallel activation operating parameter can be computed (402). The parallel activation operating parameter may be, for example, a flash gas generated by the receiver, such as described above with respect to FIG. 3.

A determination is made of whether a first parallel activation operating parameter is within a particular operating range (404). If the first parallel activation operating parameter is not within the particular operating range, the timer is reset and the system operates without parallel compression (406).

If the first parallel activation operating parameter is within the particular operating range, the first compressor (which may be, for example, transcritical compressor 154*a* or transcritical compressor 154*b*) is activated to operate as a parallel compressor (408). For example, the first of the suction group can be activated in response to determining that a flash gas percentage is greater than a particular value. Activation of a compressor as a parallel compressor can be accomplished by operation of the modulating 3-way valve and/or gas bypass valve as described above relative to FIGS. 1-3.

Once the compressor is operating as a parallel compress, the controller can adjust the speed of the compressor (e.g., using a VFD or digital unloader) to maintain one or more operating parameters in the refrigeration system (e.g., the pressure in the receiver) at a set point.

During operation of the first compressor as a parallel compressor, a determination is made of whether a second parallel activation operating parameter is within a particular operating range. (410). For example, a second activation operating parameter can include whether the first compressor operating as a parallel compressor is operating at a maximum speed.

If the second parallel activation operating parameter is not within the particular operating range, the timer is reset and the system operates without a second parallel compressor. (412).

If the second parallel activation operating parameter is within the particular operating range (for example, if the speed of the first compressor is at the maximum for the compressor, the first compressor is fully loaded (de-energized), or the first compressor is running at its full capacity), the second compressor is activated to operate as a parallel compressor (414).

In one example, one of the input parameters is receiver pressure to activate the second parallel compressor. If the first parallel compressor is running at its full capacity and receiver pressure is going above the set point range, then the second parallel compressor can be activated to maintain the set receiver pressure. If there are only two parallel compressors available and running at full capacity (both compressors are running at full speed) and if the receiver pressure is keep going above the set point, then flash gas by pass valve can be opened slowly to maintain the receiver set point pressure.

As another example, the second compressor of the suction group can be activated in response to determining that a flash gas percentage is greater than a particular value. Once the second compressor is operating as a parallel compressor, the controller adjusts the speed of the second compressor (e.g., using a VFD or digital unloader) to maintain one or more operating parameters of the refrigeration system (e.g., the receiver pressure) at a set point.

During operation of one or more of the compressors as a parallel compressor, a determination is made of whether a one or more parallel deactivation operating parameters are within a particular operating range(s) (416). If the parallel deactivation operating parameters are not within the particular operating ranges, the timer is reset and the system continues to operate with parallel compression (418). If any of the parallel deactivation operating parameters is within the particular operating range for any one the compressors, that compressor can be deactivated from operating as a parallel compressor (420).

Figure 5:
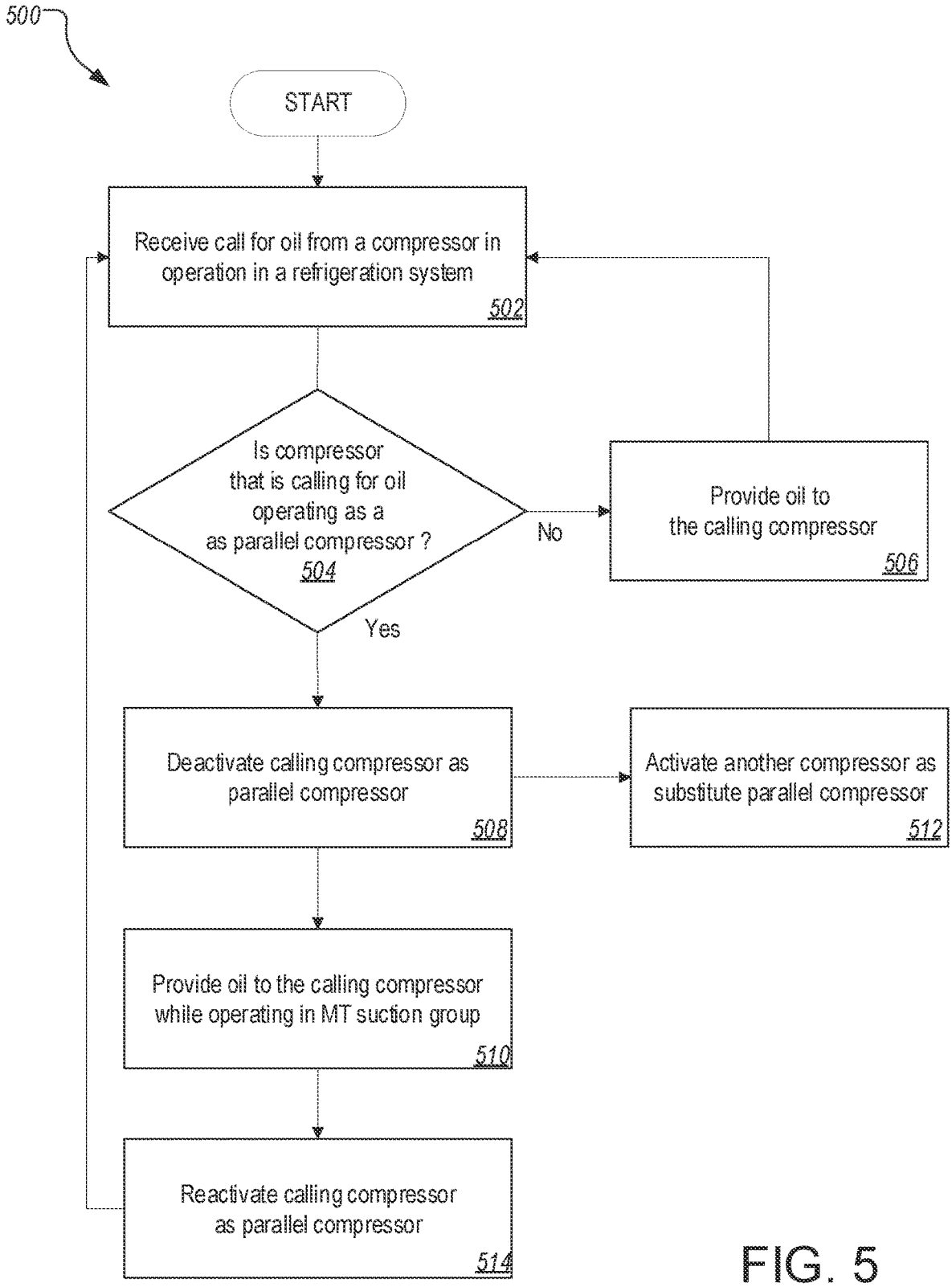
FIG. 5 is a flow diagram of an example oil management process that can be implemented on a refrigeration system having convertible compressors according to some implementations.

FIG. 5 is a flow diagram of an example oil management process 500 that can be implemented on a refrigeration system having convertible compressors according to some implementations.

Oil management processes described in this disclosure can be implemented by way of a controller. The controller can be the same as the controller used to control the main cooling components of the system (e.g., controller 122), or in a separate controller.

During operation, any of the compressors in a refrigeration system can call for oil (502). Thus, in the example shown in FIG. 1, any of transcritical compressors 154 or subcritical compressors 164 can call for oil. In some implementations, the call is in the form of a signal sent to the controller.

In response to the call, a determination is made of whether the controller that has made the call for oil is operating as parallel compressor (504). The compressors can be, for example, transcritical compressors 154*a* and 154*b* operating as parallel compressors and compressing refrigerant from receiver 110, such as described above with respect to FIGS. 1-4.

If the compressor calling for oil is not operating as a parallel compressor (e.g., operating in the MT suction group as described above with respect to FIGS. 1-4), the oil management system can provide oil to the calling compressor (506). The oil can be dispensed from a reservoir such as reservoir 193 described above relative to FIG. 1.

If the compressor calling for oil is operating as a parallel compressor (e.g., operating to receive and compress flash gas from receiver 110 as described above with respect to FIGS. 1-4), a valve system (e.g., parallel compressor activation valve 180 or parallel compressor activation valve 182) is modulated to deactivate the compressor from operating as a parallel compressor (508). The compressor can continue to operate as an MT suction group compressor (along with any other compressors active in the MT suction group). Once deactivated as a parallel compressor, oil can be dispensed to the calling compressor (510). In some implementations, one or more other compressors are activated as parallel compressors in substitution for the deactivated compressor (512). In other implementations, the calling compressor is deactivated without substitution of another compressor as a parallel compressor. In some cases, the flash gas bypass valve on the receiver can be opened to maintain receiver operating pressure.

Once the call for oil in the compressor has been addressed, and as conditions indicate, the compressor can be reactivated as a parallel compressor (e.g., by modulating a 3-way valve system to provide flash gas from the receiver to the compressor suction inlet) (514).

In the example shown in FIG. 1, a $CO_2$ refrigeration system 100 has two convertible compressors. A system may, however, in other implementations, include any number of convertible compressors. In some implementations, half of the transcritical compressors in a booster system are convertible into parallel compressors, each by way of a valve system (e.g., 4 convertible compressors out of 8 total compressors). In other implementations, all of the transcritical compressors in a booster system are convertible to parallel compressors.

In various examples described above, a facility includes low temperature and medium temperature loads and corresponding low temperature and medium temperature cooling systems. In other implementations, a facility can have only low temperature loads or only medium temperature loads and/or cooling systems.

In some implementations, a transcritical compressor operating as a parallel compressor that calls for oil is switched out of parallel compression before oil is provided to the compressor. Another compressor can be activated in parallel compression to substitute for the compressor that has been deactivated. For example, if transcritical compressor 154*a* signals the controller with a call for oil while operating as a parallel compressor, controller 122 can operate parallel compressor activation valve 180 to switch transcritical compressor 154*a* out of parallel compression. The controller can operate parallel compressor activation valve 182 to switch transcritical compressor 154*b* into parallel operation.

In various examples described above, a $CO_2$ refrigeration system is cooled by an adiabatic gas cooler. In other implementations, a $CO_2$ refrigeration system can be cooled by other systems, such as an air cooled or water cooled device.

The present disclosure contemplates methods, systems and program products on memory or other machine-readable media for accomplishing various operations. Systems and processes described in the present disclosure may be implemented using existing computer processors, or by a special purpose computer processor for an appropriate system, incorporated for this or another purpose, or by a hardwired system. Implementations within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Particular embodiments of the subject matter have been described. Other embodiments, alterations, and permutations of the described embodiments are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example embodiments do not define or constrain this disclosure. Other changes, substitutions, and alterations are also possible without departing from the spirit and scope of this disclosure.

What is claimed is:

1. A refrigeration system, comprising:

a receiver configured to collect refrigerant produced by the refrigeration system and comprising an outlet through which the gas refrigerant exits the receiver;

a gas bypass valve fluidly coupled to the outlet and operable to control a pressure of the refrigerant in the receiver by controlling a flow of the gas refrigerant from the receiver through the gas bypass valve;

a low temperature subsystem comprising one or more low temperature evaporators and one or more subcritical compressors, the one or more low temperature evaporators configured to receive liquid refrigerant from the receiver;

a medium temperature subsystem comprising:

one or more expansion valves;

one or more medium temperature evaporators; and a suction group comprising two or more transcritical compressors operable to receive gas refrigerant from the one or more subcritical compressors, compress the gas refrigerant, and discharge the compressed gas refrigerant into a discharge line;

a first valve system fluidly coupled to a first one of the transcritical compressors;

a second valve system fluidly coupled to a second one of the transcritical compressors;

a controller configured to:

determine that one or more first operating parameters are within a first operating range;

in response to the determination that the one or more first operating parameters are within the first operating range, activate the first one of the transcritical compressors to operate as a parallel compressor by modulating the first valve system to switch a suction input of the first one of the transcritical compressors from an evaporator outlet of the one or more medium temperature evaporators to the outlet of the receiver;

determine that one or more second operating parameters are within a second operating range; and in response to the determination that the one or more second operating parameters are within the second operating range, activate the second one of the transcritical compressors to operate as a parallel compressor by modulating the second valve system to switch a suction input of the second one of the transcritical compressors from an evaporator outlet of the one or more medium temperature evaporators to the outlet of the receiver;

wherein the one or more first operating parameters comprise a flash gas generated in the receiver, and the flash gas generated is determined from a percentage of flash gas bypass valve opening.

2. The refrigeration system of claim 1, wherein the refrigerant comprises carbon dioxide.

3. The refrigeration system of claim 1, wherein the controller is further configured to, in response to the determination that the one or more first operating parameters are within the first operating range, close the gas bypass valve.

4. The refrigeration system of claim 1, further comprising:

a gas cooler/condenser;

a heat exchanger system comprising:

a first coil configured to carry gas refrigerant passing between the gas cooler/condenser and an inlet of the receiver; and a second coil in heat transfer communication with the first coil, the second coil configured to carry gas refrigerant passing between the outlet of the receiver and a port of at least one of the first valve system and the second valve system, wherein the heat exchanger system is configured to transfer heat from the second coil to first coil.

5. The refrigeration system of claim 1, further comprising an ejector system fluidly coupled between the gas cooler/condenser and the receiver.

6. The refrigeration system of claim 1, wherein the one or more second operating parameters comprise a flash gas generated.

7. The refrigeration system of claim 1, wherein the one or more second operating parameters comprise a receiver operating pressure set point.

8. The refrigeration system of claim 1, further comprising a variable frequency drive coupled to the first one of the transcritical compressors, wherein the controller is configured to operate the variable frequency drive to modulate a speed of the first one of the transcritical compressors.

9. The refrigeration system of claim 7, wherein the controller is further configured to operate the variable frequency drive to modulate a speed of the first one of the transcritical compressors to maintain a receiver operating pressure set point.

10. The refrigeration system of claim 1, further comprising a variable frequency drive coupled to the second one of the transcritical compressors, wherein the controller is configured to operate the variable frequency drive to modulate a speed of the second one of the transcritical compressors.

11. The refrigeration system of claim 1, further comprising one or more digital unloaders, wherein the controller is configured to operate the one or more digital unloaders to modulate a flow rate through at least one of the two or more transcritical compressors.

12. The refrigeration system of claim 1, wherein at least one of the first valve system and the second valve system comprises a three-way valve configured to switch the suction input of the transcritical compressor between gas refrigerant from the one or more medium temperature evaporators and gas refrigerant from the outlet of the receiver.

13. The refrigeration system of claim 1, wherein the controller is further configured to, in response to a determination that one or more third operating parameters are within a third operating range, deactivate the first one of the transcritical compressors.

14. The refrigeration system of claim 1, further comprising a low temperature subsystem configured to receive liquid refrigerant from the receiver.

15. A refrigeration system, comprising:

a receiver configured to collect refrigerant produced by the refrigeration system and comprising an outlet through which the gas refrigerant exits the receiver;

a gas bypass valve fluidly coupled to the outlet and operable to control a pressure of the refrigerant in the receiver by controlling a flow of the gas refrigerant from the receiver through the gas bypass valve;

a medium temperature subsystem, comprising:

one or more expansion valves;

one or more medium temperature evaporators; and a suction group comprising two or more transcritical compressors operable to compress gas refrigerant and discharge the compressed gas refrigerant into a discharge line;

a first valve system fluidly coupled to a first one of the transcritical compressors;

a second valve system fluidly coupled to a second one of the transcritical compressors;

an oil management subsystem, comprising oil reservoir; and a controller configured to:

determine that one or more first operating parameters are within a first operating range;

in response to the determination that the one or more first operating parameters are within the first operating range, activate the first one of the transcritical compressors to operate as a parallel compressor by modulating the first valve system to switch a suction input of the first one of the transcritical compressors from an evaporator outlet of the one or more medium temperature evaporators to the outlet of the receiver;

determine that one or more second operating parameters are within a second operating range;

in response to the determination that the one or more second operating parameters are within the second operating range, activate the second one of the transcritical compressors to operate as a parallel compressor by modulating the second valve system to switch a suction input of the second one of the transcritical compressors from an evaporator outlet of the one or more medium temperature evaporators to the outlet of the receiver; and in response to receiving a signal calling for oil from a compressor that is operating as a parallel compressor:

deactivating the compressor from operating as a parallel compressor by modulating the input flow of refrigerant to the compressor from the outlet of the receiver to one or more evaporators, activate another one of the transcritical compressors to operate as a parallel compressor by modulating an input flow of refrigerant from the one or more evaporators to the outlet of the receiver, and provide oil from the reservoir to compressor that has been deactivated as a parallel compressor.

16. A refrigeration system, comprising:

a receiver configured to collect refrigerant produced by the refrigeration system and comprising an outlet through which the gas refrigerant exits the receiver;

a gas bypass valve fluidly coupled to the outlet and operable to control a pressure of the refrigerant in the receiver by controlling a flow of the gas refrigerant from the receiver through the gas bypass valve;

a medium temperature subsystem comprising:

one or more expansion valves;

one or more medium temperature evaporators; and a suction group comprising two or more transcritical compressors operable to compress gas refrigerant and discharge the compressed gas refrigerant into a discharge line;

a first valve system fluidly coupled to a first one of the transcritical compressors;

a second valve system fluidly coupled to a second one of the transcritical compressors;

a controller configured to:

determine that one or more first operating parameters are within a first operating range;

in response to the determination that the one or more first operating parameters are within the first operating range, activate the first one of the transcritical compressors to operate as a parallel compressor by modulating the first valve system to switch a suction input of the first one of the transcritical compressors from an evaporator outlet of the one or more medium temperature evaporators to the outlet of the receiver;

determine that one or more second operating parameters are within a second operating range; and in response to the determination that the one or more second operating parameters are within the second operating range, activate the second one of the transcritical compressors to operate as a parallel compressor by modulating the second valve system to switch a suction input of the second one of the transcritical compressors from an evaporator outlet of the one or more medium temperature evaporators to the outlet of the receiver;

wherein the one or more first operating parameters comprise a flash gas generated in the receiver, and the flash gas generated is determined from a percentage of flash gas bypass valve opening.

17. The refrigeration system of claim 16, wherein the controller is further configured to, in response to the determination that the one or more first operating parameters are within the first operating range, close the gas bypass valve.

18. The refrigeration system of claim 16, further comprising a variable frequency drive coupled to the first one of the transcritical compressors, wherein the controller is configured to operate the variable frequency drive to modulate a speed of the first one of the transcritical compressors.

19. A refrigeration system, comprising:

a receiver configured to collect refrigerant produced by the refrigeration system and comprising an outlet through which the gas refrigerant exits the receiver;

a gas bypass valve fluidly coupled to the outlet and operable to control a pressure of the refrigerant in the receiver by controlling a flow of the gas refrigerant from the receiver through the gas bypass valve;

a low temperature subsystem comprising one or more low temperature evaporators and one or more subcritical compressors, the one or more low temperature evaporators configured to receive liquid refrigerant from the receiver;

a medium temperature subsystem comprising:

one or more expansion valves;

one or more medium temperature evaporators; and a suction group comprising two or more transcritical compressors operable to receive gas refrigerant from the one or more subcritical compressors, compress the gas refrigerant, and discharge the compressed gas refrigerant into a discharge line;

a first valve system fluidly coupled to a first one of the transcritical compressors;

a second valve system fluidly coupled to a second one of the transcritical compressors;

a controller configured to:

determine that one or more first operating parameters are within a first operating range;

in response to the determination that the one or more first operating parameters are within the first operating range, activate the first one of the transcritical compressors to operate as a parallel compressor by modulating the first valve system to switch a suction input of the first one of the transcritical compressors from an evaporator outlet of the one or more medium temperature evaporators to the outlet of the receiver;

determine that one or more second operating parameters are within a second operating range;

in response to the determination that the one or more second operating parameters are within the second operating range, activate the second one of the transcritical compressors to operate as a parallel compressor by modulating the second valve system to switch a suction input of the second one of the transcritical compressors from an evaporator outlet of the one or more medium temperature evaporators to the outlet of the receiver; and in response to a determination that one or more third operating parameters are within a third operating range, deactivate the second of the transcritical compressors from operating as a parallel compressor.

20. A refrigeration system, comprising:

a receiver configured to collect refrigerant produced by the refrigeration system and comprising an outlet through which the gas refrigerant exits the receiver;

a gas bypass valve fluidly coupled to the outlet and operable to control a pressure of the refrigerant in the receiver by controlling a flow of the gas refrigerant from the receiver through the gas bypass valve;

a low temperature subsystem comprising one or more low temperature evaporators and one or more subcritical compressors, the one or more low temperature evaporators configured to receive liquid refrigerant from the receiver;

a medium temperature subsystem comprising:

one or more expansion valves;

one or more medium temperature evaporators; and a suction group comprising two or more transcritical compressors operable to receive gas refrigerant from the one or more subcritical compressors, compress the gas refrigerant, and discharge the compressed gas refrigerant into a discharge line;

a first valve system fluidly coupled to a first one of the transcritical compressors;

a second valve system fluidly coupled to a second one of the transcritical compressors;

a controller configured to:

determine that one or more first operating parameters are within a first operating range;

in response to the determination that the one or more first operating parameters are within the first operating range, activate the first one of the transcritical compressors to operate as a parallel compressor by modulating the first valve system to switch a suction input of the first one of the transcritical compressors from an evaporator outlet of the one or more medium temperature evaporators to the outlet of the receiver;

determine that one or more second operating parameters are within a second operating range;

in response to the determination that the one or more second operating parameters are within the second operating range, activate the second one of the transcritical compressors to operate as a parallel compressor by modulating the second valve system to switch a suction input of the second one of the transcritical compressors from an evaporator outlet of the one or more medium temperature evaporators to the outlet of the receiver;

determine that one or more third operating parameters are within a third operating range; and in response to the determination that the one or more third operating parameters are within the third operating range, activate a third one of the transcritical compressors to operate as a parallel compressor by modulating a third valve system to switch a suction input of the third one of the transcritical compressors from an evaporator outlet of the one or more medium temperature evaporators to the outlet of the receiver.

* * * * *